US006230929B1

(12) United States Patent
Phelps et al.

(10) Patent No.: US 6,230,929 B1
(45) Date of Patent: May 15, 2001

(54) FOLDED SHEET ADAPTER

(75) Inventors: Stephen Lawrence Phelps, Lilburn; Richard Paul Lewis, Marietta; Paul Francis Tramontina, Alpharetta, all of GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/303,798

(22) Filed: Apr. 30, 1999

Related U.S. Application Data

(63) Continuation of application No. 29/092,259, filed on Aug. 14, 1998, now Pat. No. Des. 429,930.
(60) Provisional application No. 60/096,557, filed on Aug. 14, 1998.

(51) Int. Cl.[7] ..... A47K 10/24; B65H 1/00
(52) U.S. Cl. ..... 221/46; 221/49; 221/61
(58) Field of Search ..... 221/45, 46, 47, 221/55, 61, 63, 62, 283, 287

(56) References Cited

U.S. PATENT DOCUMENTS

| | | | |
|---|---|---|---|
| D. 283,574 | 4/1986 | Bernard | D6/522 |
| D. 310,759 | 9/1990 | Breger | D6/523 |

(List continued on next page.)

FOREIGN PATENT DOCUMENTS

| | | |
|---|---|---|
| 618285 | 4/1961 | (CA) . |
| 893001 | 2/1972 | (CA) . |
| 1151121 | 8/1983 | (CA) . |
| 3127358 | 1/1983 | (DE) . |
| 8708274 | 9/1987 | (DE) . |
| 331027 | 9/1989 | (EP) . |
| 444444 | 9/1991 | (EP) . |
| 690187 | 4/1953 | (GB) . |
| 1002215 | 8/1965 | (GB) . |
| 1112680 | 5/1968 | (GB) . |
| 1443111 | 7/1976 | (GB) . |
| 1476303 | 6/1977 | (GB) . |
| 89/12418 | 12/1989 | (WO) . |
| 97/09918 | 3/1997 | (WO) . |
| 97/43938 | 11/1997 | (WO) . |
| 98/02078 | 1/1998 | (WO) . |

OTHER PUBLICATIONS

Derwent WPI Abstract DE 3127358 A, Patent Assignee: Wagner H.

Abstract DE 4006224, German Counterpart of EP 444444 listed under Foreign Patent Documents.

PCT International Search Report dated Jan. 12, 2000.

*Primary Examiner*—Joseph E. Valenza
*Assistant Examiner*—Gene O. Crawford
(74) *Attorney, Agent, or Firm*—Dority & Manning

(57) ABSTRACT

An adapter for dispensing a plurality of vertically stacked, interfolded sheets is disclosed herein, the adapter being configured to fit within a standard vertically-stacked dual roll dispenser. The adapter includes a housing having an interior adapted to receive a plurality of vertically stacked, interfolded sheets. Each sheet may include a leading edge and a trailing edge separated by spaced-apart side edges. The housing may include a front wall, a back wall spaced apart from the front wall, and two spaced-apart side walls, each side wall extending between the back wall and the front wall. The housing may further include a bottom wall including a boss that extends upwardly into the interior of the housing. An opening having a width dimension is formed in the front wall, the opening adapted to dispense vertically stacked interfolded sheets from the interior of the housing. The side edges of the sheets are urged inwardly by the width dimension of the opening as the sheets pass through the opening. A door may also be provided, the door being pivotably attached to the housing.

17 Claims, 9 Drawing Sheets

U.S. PATENT DOCUMENTS

| | | | |
|---|---|---|---|
| D. 310,923 | 10/1990 | Breger | D6/522 |
| D. 316,200 | 4/1991 | Dawson | D6/518 |
| D. 316,788 | 5/1991 | Fischer et al. | D6/515 |
| D. 321,803 | 11/1991 | Dawson | D6/518 |
| D. 331,515 | 12/1992 | Petterson et al. | D6/518 |
| D. 332,214 | 1/1993 | Mulder et al. | D9/339 |
| D. 337,227 | 7/1993 | Giugiaro | D6/518 |
| D. 396,370 | 7/1998 | Romero | D6/523 |
| D. 396,492 | 7/1998 | Carlson et al. | D19/86 |
| D. 397,265 | 8/1998 | Badillo | D6/520 |
| D. 406,974 | 3/1999 | King et al. | D6/518 |
| 1,170,380 | 2/1916 | Winter . | |
| 1,577,094 | 3/1926 | Arms . | |
| 1,588,733 | 6/1926 | Hoberg . | |
| 1,724,428 | 8/1929 | Sherman . | |
| 2,000,454 | 5/1935 | Peters | 206/57 |
| 2,050,030 | 8/1936 | Winter | 206/57 |
| 2,529,853 | 11/1950 | Taggart | 206/57 |
| 2,656,916 | 10/1953 | Henderson | 206/57 |
| 2,730,267 | 1/1956 | Marcalus | 221/48 |
| 2,765,909 | 10/1956 | Graham | 206/57 |
| 2,840,266 | 6/1958 | Nelson | 221/48 |
| 2,840,267 | 6/1958 | Nelson | 221/48 |
| 2,927,714 | 3/1960 | Nelson | 221/48 |
| 3,036,729 | 5/1962 | Asman | 221/48 |
| 3,095,996 | 7/1963 | Babin | 221/52 |
| 3,144,961 | 8/1964 | Phenner | 221/48 |
| 3,178,054 | 4/1965 | Lindecker | 221/58 |
| 3,207,361 | 9/1965 | Marcalus | 221/48 |
| 3,224,632 | 12/1965 | Marcalus | 221/48 |
| 3,239,097 | 3/1966 | Bates et al. | 221/48 |
| 3,266,666 | 8/1966 | Nelson | 221/48 |
| 3,369,698 | 2/1968 | Scholz | 221/48 |
| 3,490,645 | 1/1970 | Glass et al. | 221/48 |
| 3,606,082 | 9/1971 | Kuchenbecker | 221/52 |
| 3,780,908 | 12/1973 | Fitzpatrick et al. | 221/48 |
| 3,819,043 | 6/1974 | Harrison | 206/449 |
| 4,512,478 | 4/1985 | Korte | 206/611 |
| 4,623,074 | 11/1986 | Dearwester | 221/48 |
| 4,678,099 | 7/1987 | Matsui | 221/48 |
| 4,768,679 | 9/1988 | Matsui | 221/48 |
| 4,877,154 | 10/1989 | Matsui | 221/48 |
| 4,913,312 | 4/1990 | Boutin | 221/45 |
| 5,074,430 | 12/1991 | Roberts | 221/44 |
| 5,102,007 * | 4/1992 | Petterson et al. | 221/47 X |
| 5,154,496 | 10/1992 | Campbell et al. | 312/34.8 |
| 5,219,421 | 6/1993 | Tipping | 221/63 |
| 5,605,265 | 2/1997 | Hanna | 225/46 |
| 5,884,804 | 3/1999 | King | 221/45 |
| 5,950,863 * | 9/1999 | Schutz et al. | 221/46 X |

* cited by examiner

FOLDED SHEET ADAPTER

This application claims priority from U.S. Provisional Application No. 60/096,557, filed on Aug. 14, 1998 and which is a contuation of U.S. Design Application No. 29/092,259, filed on Aug. 14, 1998, now U.S. Pat. No. Des. 429,930.

FIELD OF THE INVENTION

The present invention is directed generally to folded sheet adapters for roll dispensers, and more particularly to bottom-dispensing folded sheet adapters for standard, vertically stacked dual roll dispensers.

BACKGROUND OF THE INVENTION

A wide variety of dispensers are available for dispensing materials such as tissues, paper towels and the like. Most dispensers are configured to dispense such materials either from a roll or from a stack of interfolded sheets. Dispensers for multiple rolls of paper material, such as rolls of bathroom tissue, are also well known in the art. With typical conventional dispensers of this type, two rolls of tissue are vertically oriented within the dispenser so that the top roll falls or otherwise is moved into a dispensing position when the bottom roll is depleted. In selected applications, the use of stacked, interfolded sheets offers several advantages to users over materials in roll form.

Unfortunately, dispensers configured to dispense materials from rolls are not typically able to dispense stacked, interfolded sheets. Thus, when a user desires to switch from dispensing rolled materials to dispensing stacked, interfolded materials, a new dispenser must be purchased and installed. To avoid the additional cost and labor incurred in installing a new dispenser, an adapter is needed which enables a user to easily and inexpensively adapt a roll dispenser to dispense stacked, interfolded sheets.

In selected circumstances, it may be desirable to alternate between dispensing rolled materials and dispensing stacked, interfolded sheets. In such circumstances, an adapter must be able to be installed into the roll dispenser without damaging the mechanisms within the dispenser which permit rolled materials to be dispensed. Thus, it may be desirable that an adapter be easily removed from and reinstalled into the rolled material dispenser.

SUMMARY OF THE INVENTION

The present invention is directed to an adapter for dispensing a plurality of vertically stacked, interfolded sheets. The adapter is configured to fit within a dispenser which dispenses rolled materials. In selected embodiments, the adapter is configured to be placed within a dispenser which dispenses two vertically stacked rolls of material. The adapter includes a housing having an interior that is adapted to receive a plurality of vertically stacked, interfolded sheets. Each sheet includes a leading edge and a trailing edge separated by spaced-apart side edges. The housing may include a bottom wall. In some embodiments, a boss is disposed on the bottom wall, the boss extending upwardly into the interior of the housing. The housing may also include a front wall, a back wall spaced apart from the front wall, and two spaced-apart side walls, each side wall extending between the back wall and the front wall.

An opening is formed in the housing and, in selected embodiments, is disposed on the front wall. The opening is characterized by a width dimension and a height dimension.

In some embodiments, the width dimension is greater than the height dimension. The opening may be variously shaped and is adapted to dispense vertically stacked interfolded sheets from the interior of the housing. The side edges of the sheets may be urged inwardly by the width dimension of the opening as the sheets pass through the opening.

In some embodiments, a door may be attached to the housing, the door adapted to permit ease of access to the interior of the housing. The door may be pivotably or otherwise attached to the housing.

In certain embodiments, the front wall further includes an upper portion and a lower portion joined along a front edge. In such embodiments, the opening may be disposed on the lower portion of the front wall. A first interior angle formed by the lower portion and the upper portion of the front wall may, in particular embodiments, be less than 180 degrees.

Similarly, the back wall may also include an upper portion and a lower portion joined at a back edge. A second interior angle formed by the lower portion and the upper portion of the back wall may be less than 180 degrees.

An attachment mechanism may be provided, the attachment mechanism being adapted to attach the housing to a dual roll vertically stacked dispenser. In some embodiments, the attachment mechanism may include an adhesive and may be positioned on the back wall of the housing.

DETAILED DESCRIPTION OF THE INVENTION

Figure 1:
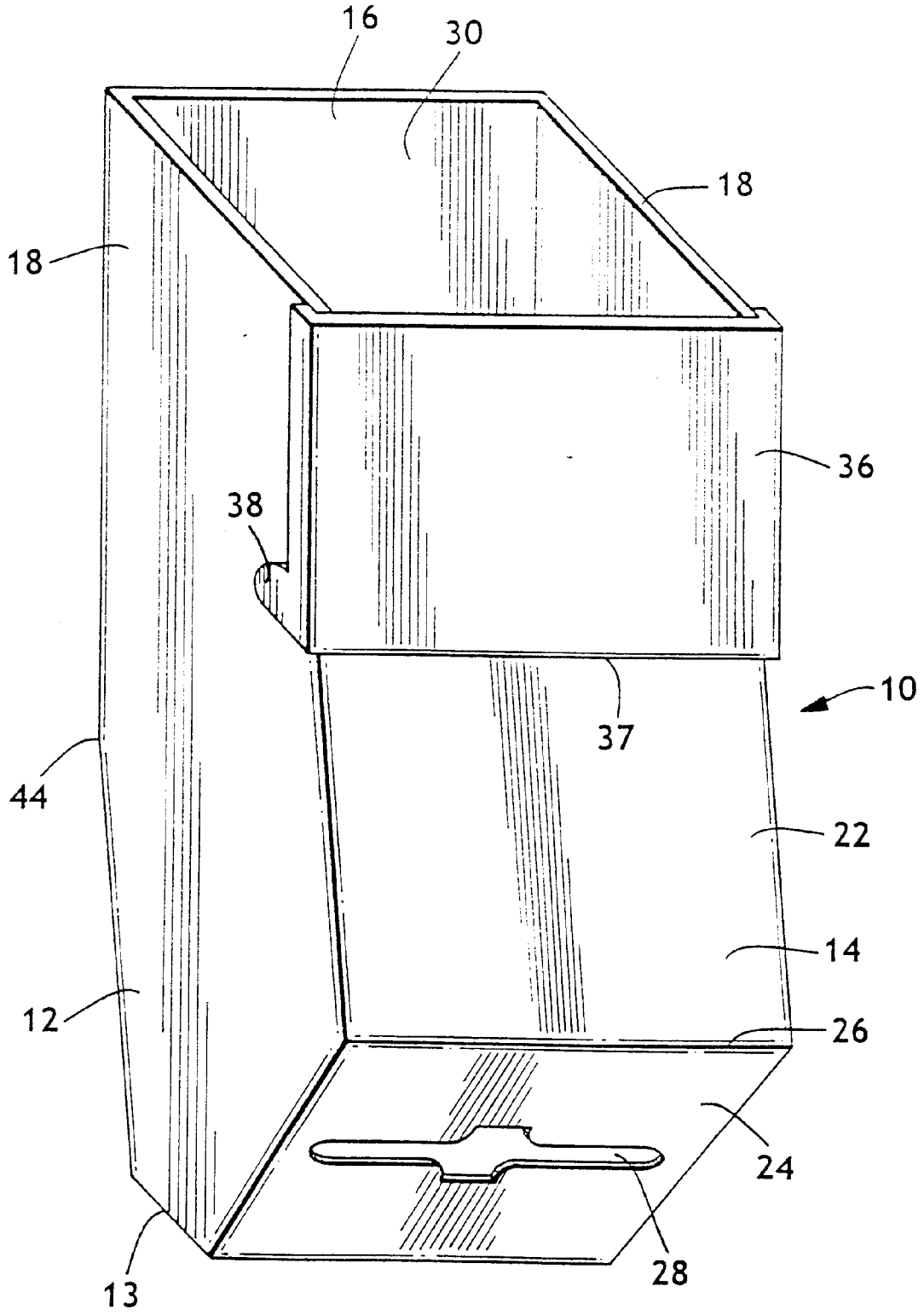
FIG. 1 is a perspective view of an adapter according to the present invention.

Referring now to FIG. 1, a tissue or paper towel adapter 10 is shown therein. The adapter 10 includes a housing 12 sized for receiving a dispensable material such as, for example, a plurality of folded tissues or paper towels. Although the housing 12 may be variously configured, the housing 12, as shown in FIGS. 1, 3 and 4, includes a bottom wall 13, a front wall 14, a back wall 16, and two spaced-apart side walls 18, the front wall 14 and the back wall 16 being separated by the side walls 18.

As shown in the embodiment depicted in FIG. 1, the front wall 14 includes an upper portion 22 and a lower portion 24 which are joined along a front edge 26. Disposed on the front wall 14 is an opening 28. The opening 28 may be formed in a variety of shapes. In selected embodiments, the opening 28 is positioned on the lower portion 24 of the front wall 14. Sheets such as, for example, tissues, paper towels or other materials that are disposed within the interior 30 of the housing 12 are dispensed through the opening 28.

Figure 2:
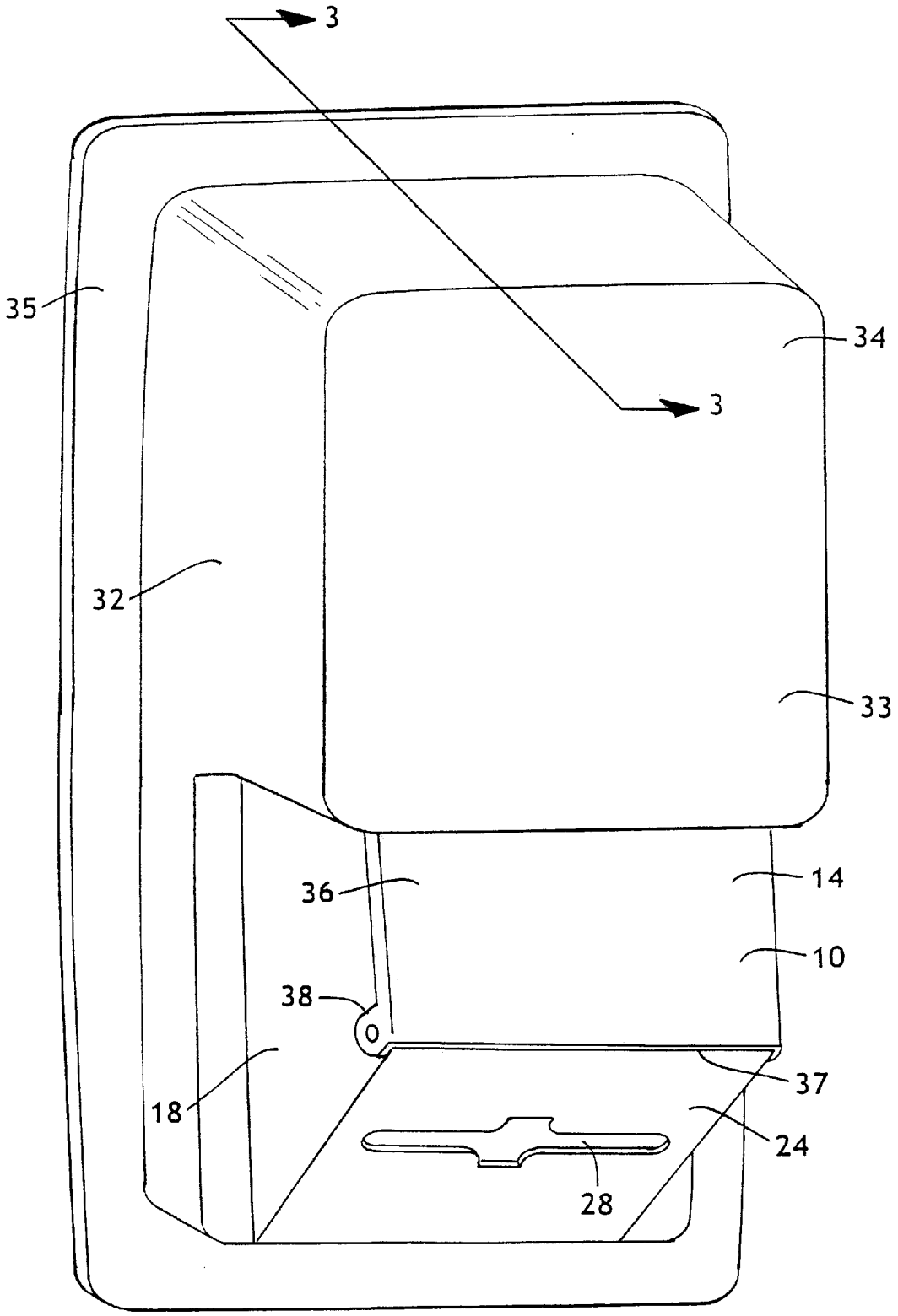
FIG. 2 is a perspective view of an alternate embodiment of an adapter according to the present invention positioned within a dispenser which dispenses two vertically stacked roll of material.

The adapter 10 is configured to be placed within a dispenser which dispenses rolled materials such as, for example, tissues or paper towels. In selected embodiments and as shown in FIGS. 2 and 3, the adapter 10 may be placed within a dispenser 32. The dispenser 32 may include a front 33, a back 31 and a removable cover 34. As shown in FIG. 3, the back 31 of the dispenser 32 may be mounted to a support member such as the wall 35. The dispenser 32 may also be mounted to or supported by a wide variety of structures such as a shelf, counter or the like.

Figure 3:
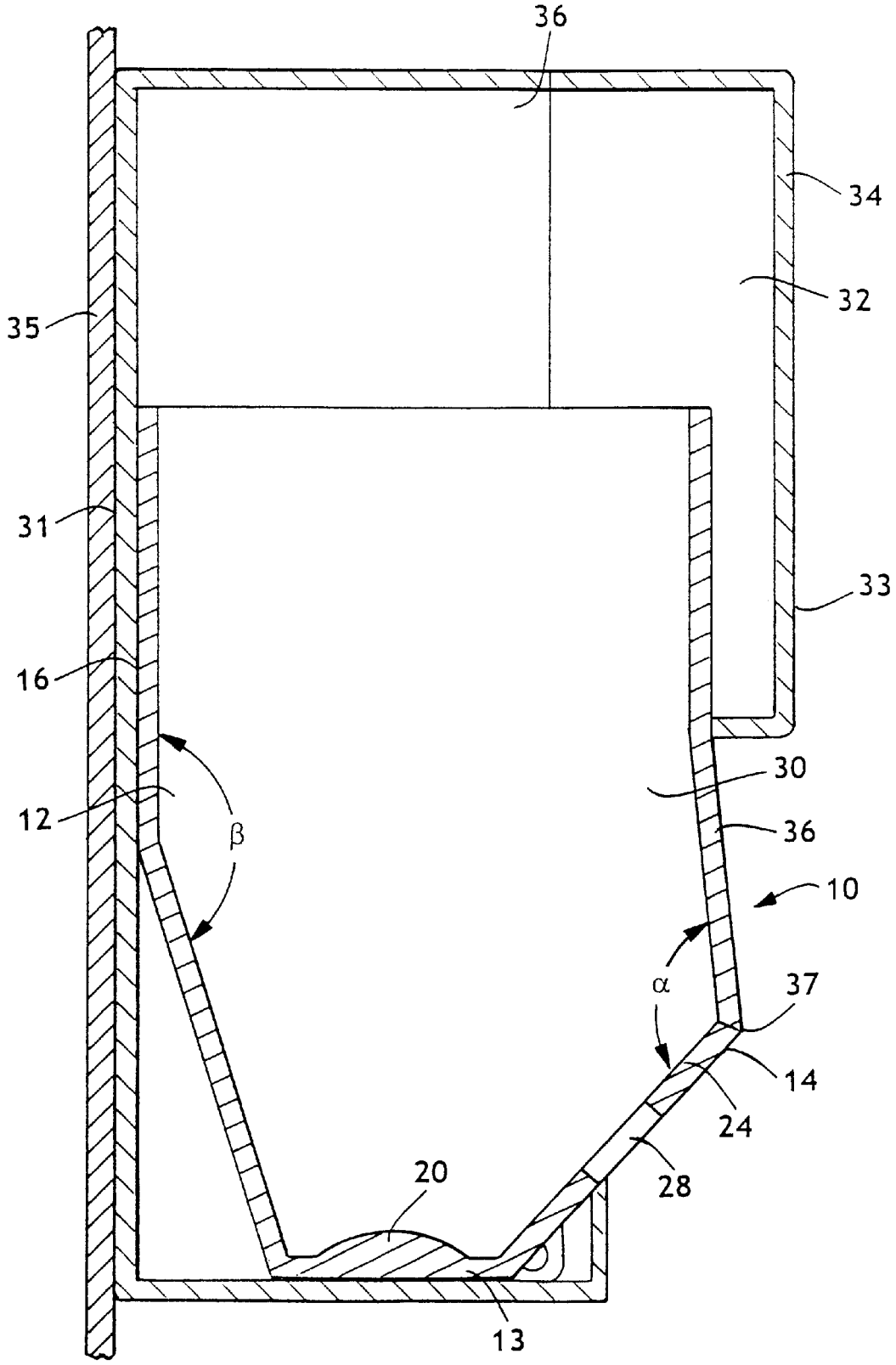
FIG. 3 is a cross-sectional view of the embodiment of the adapter depicted in FIG. 2, taken along line 3—3.
Figure 4:
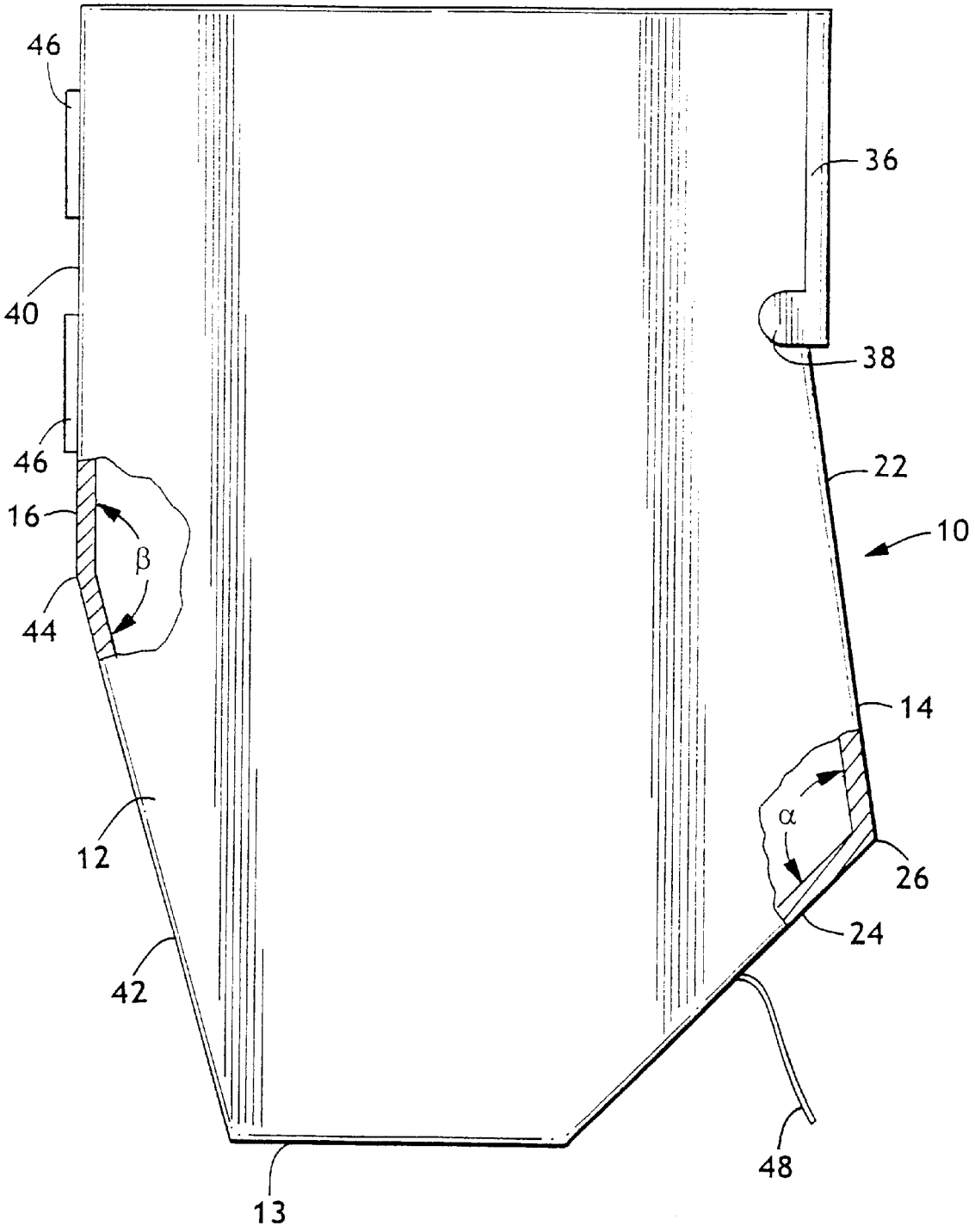
FIG. 4 is a partial cross-sectional side view of another embodiment of the adapter of the present invention.

FIG. 3 depicts a cross-section of the embodiment shown in FIG. 2 taken along line 3—3. As shown therein, the adapter 10 is at least partially supported by the dispenser 32. The adapter 10 is positioned within the dispenser 32 so that the front wall 14 of the adapter 10 faces the same direction as the front 33 of the dispenser 32. Thus, an individual facing the front 33 of the dispenser 32 is also facing the front wall 14 of the adapter 10.

As shown in FIGS. 1 and 3, the adapter 10 may also include a door 36 attached to the housing 12. The door 36 is attached to the housing 12 in a manner which permits easy access to the interior 30 of the housing 12. Thus, a user may open the door 36 to fill the interior 30 of the housing 12 with materials such as stacked, interfolded tissues or paper towels. After filling the interior 30 of the housing 12, the user may close the door 36 to the housing 12.

Figure 5:
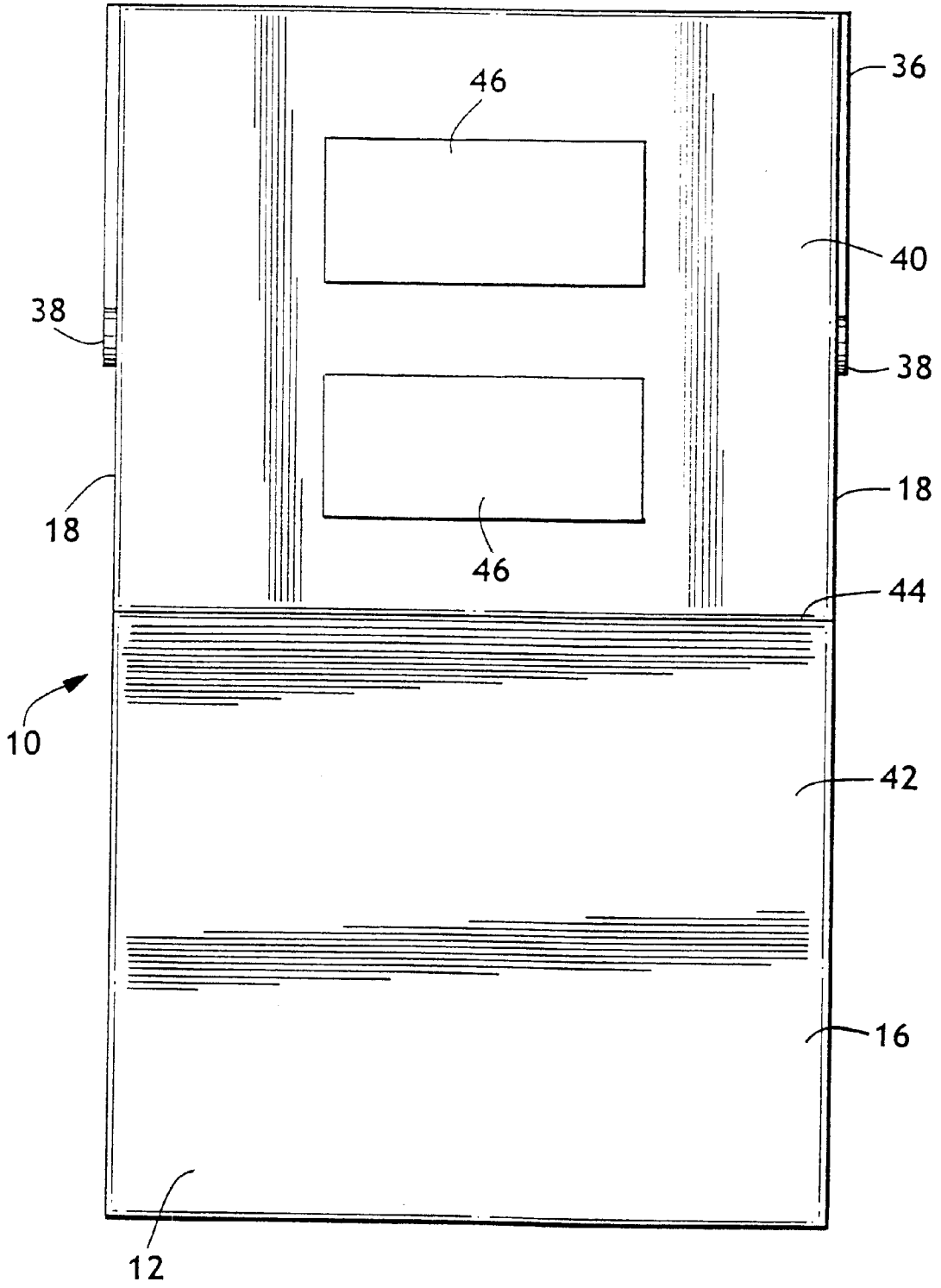
FIG. 5 is a rear view of the embodiment of the adapter depicted in FIG. 4.

The door 36 may be variously configured and attached to the housing 12 so that the door may be opened by sliding, pivoting, detaching, or the like. A variety of attachment mechanisms may be utilized, including, for example, a living hinge, sliding members such as interlocking guide tracks, mechanical fasteners such as screws or rivets, or hinges. As shown in FIGS. 1, 2 and 5, a pair of hinges 38 is utilized to attach the door 36 to the housing 12. In particular embodiments, the hinges 38 may be positioned at the lower edge 37 of the door 36. The lower edge 37 of the door 36 may be positioned proximate to the upper portion 22 of the front wall 14, as shown in FIGS. 1 and 4. The lower edge 37 of the door 36 may also be positioned proximate to the lower portion 24 of the front wall 14, as shown in FIGS. 2 and 3. In alternate embodiments, the door 36 may be pivotably attached at its upper edge to the housing 12.

Thus, when the adapter 10 has been positioned within the dispenser 32, the interior 30 of the housing 12 may be easily refilled with materials by pivoting the cover 34 of the dispenser 32 outwardly or removing the cover 34 from the dispenser 32 and opening the door 36 of the housing 12. In such embodiments, sheets of tissue or other material may be placed within the interior 30 of the housing 12 without removing the adapter 10 from the dispenser 32.

In particular embodiments and as best shown in FIG. 4, the upper portion 22 and lower portion 24 of the front wall 14 form a first interior angle $\alpha$ within the interior 30 of the housing 12. In selected embodiments, the first interior angle $\alpha$ is less than 180 degrees. The lower and upper portions 22 and 24 may be planar or curved. In the embodiment depicted in FIG. 3, the first interior angle $\alpha$ is formed between the lower portion 24 of the front wall 14 and the door 36.

In some embodiments and as shown in FIG. 4, the back wall 16 of the housing 12 may also include an upper portion 40 and a lower portion 42 which intersect along a back edge 44. The upper portion 40 and lower portion 42 form a second interior angle $\beta$ within the interior 30 of the housing 12. In selected embodiments, the second interior angle $\beta$ is less than 180 degrees. The lower and upper portions 40 and 42 may be planar or curved.

The interior angles $\alpha$ and $\beta$ formed in the front and back walls, 14 and 16, respectively, assist in positioning sheets within the interior 30 of the housing 12 so that they may be easily removed through the opening 28. In certain embodiments, the bottom wall 13 may also be variously angled with respect to the front and back walls. As shown in the embodiment depicted in FIG. 3, a boss 20 is provided which extends upwardly from the bottom wall 13 into the interior 30 of the housing 12. The boss 20 may be formed to assist in moving the materials to be dispensed into a position so that they may be easily removed from the housing 12.

Figure 6:
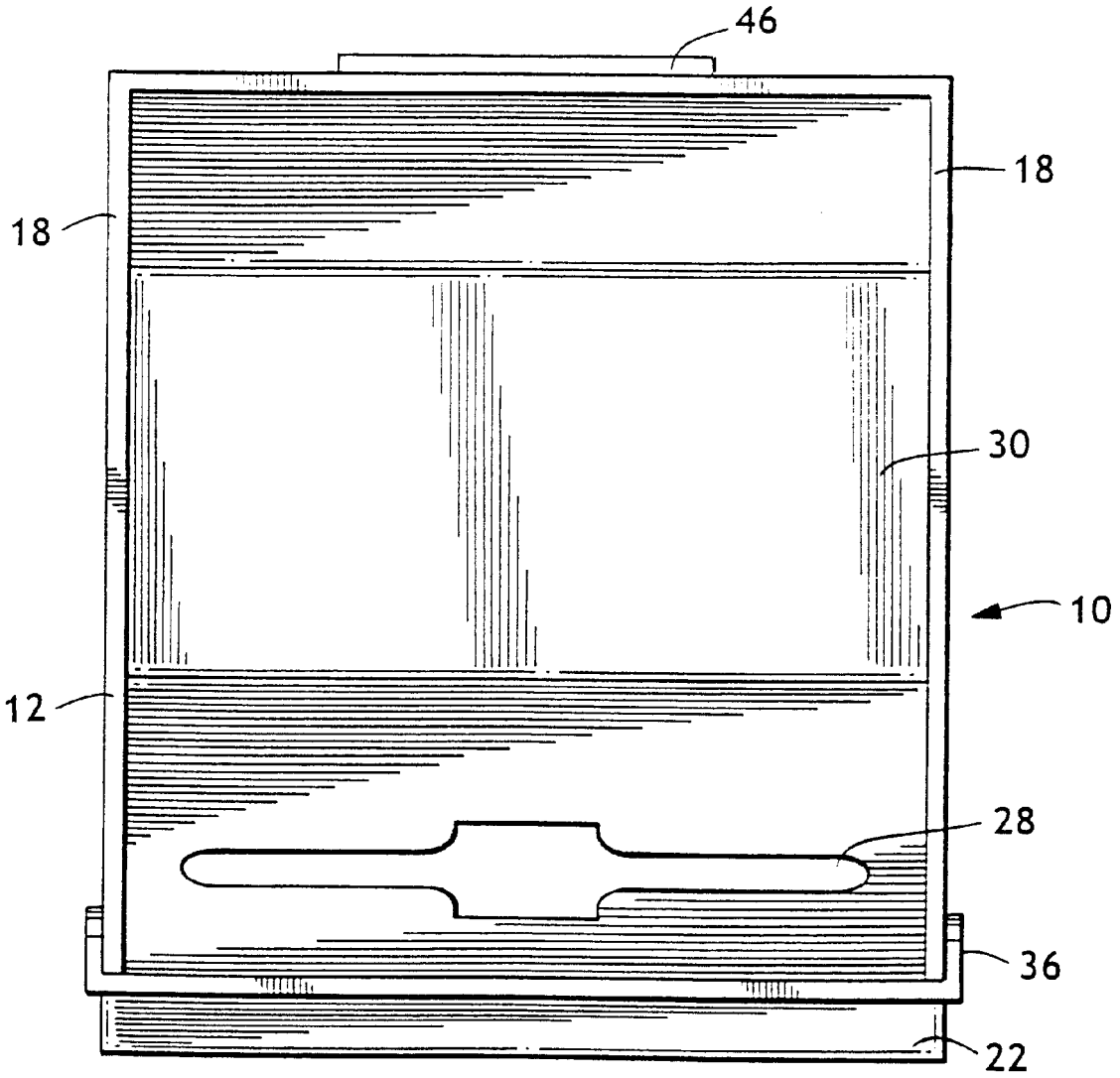
FIG. 6 is a top view of the embodiment of the adapter depicted in FIG. 4.

The adapter 10 may be secured within the dispenser 32 in a variety of ways, including adhesively attaching the adapter 10 to the dispenser or utilizing mechanical fasteners such as screws, bolts, and the like. For example, at least one length of a two-sided adhesive tape may be secured to an exterior surface of the housing 12. As shown in FIGS. 4, 5 and 6, a pair of two-sided adhesive tape strips 46 are secured to the back wall 16 of the housing 12. If desired, the adapter 10 may be removably secured to the dispenser 32 to permit easy removal and replacement of the adapter 10 without altering the original function of the dispenser 32, thereby enabling a single dispenser to be easily converted to dispense material from either rolls or sheets.

The adapter 10, as described herein, may be constructed of a variety of materials, such as metals, plastics or other materials. The construction of the adapter 10 will depend on which materials are utilized. For example, a variety of plastics may be utilized to mold a one-piece unitary housing 12.

FIGS. 7 and 8A–8E illustrate alternate configurations of the opening 28. In each of the FIGS. 7 and 8A–8E, the opening 28 has a length dimension A, illustrated by broken line A, and a width dimension B, illustrated by broken line B. In some embodiments, the length dimension A extends horizontally when the adapter 10 is mounted within a dispenser 32. In other embodiments, the width dimension B may extend horizontally when the adapter is mounted within the dispenser 32. The opening 28 may also be otherwise oriented with respect to the dispenser to assist in removal of the folded, stacked materials from the interior 30 of the housing 12.

Figure 8A:
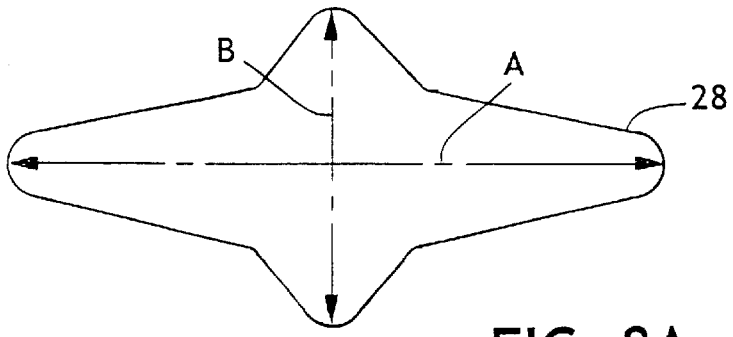
FIGS. 8A–8E illustrate various opening shapes suitable for use with the adapter of the present invention.
Figure 8B:
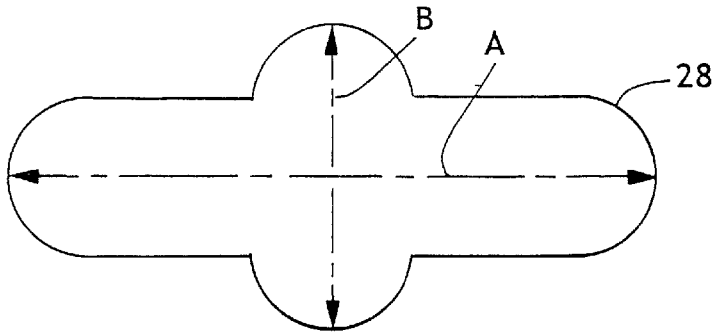
Figure 8C:
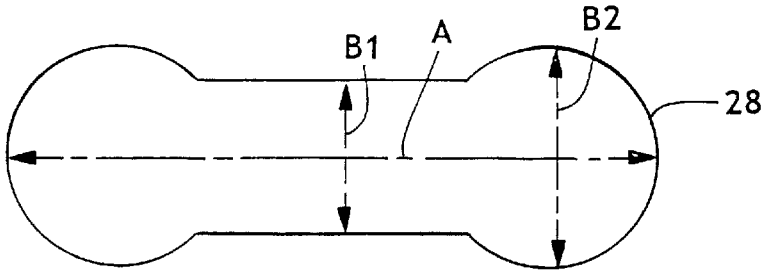
Figure 8D:
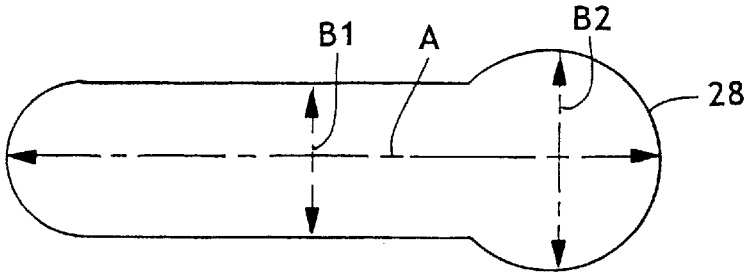
Figure 8E:
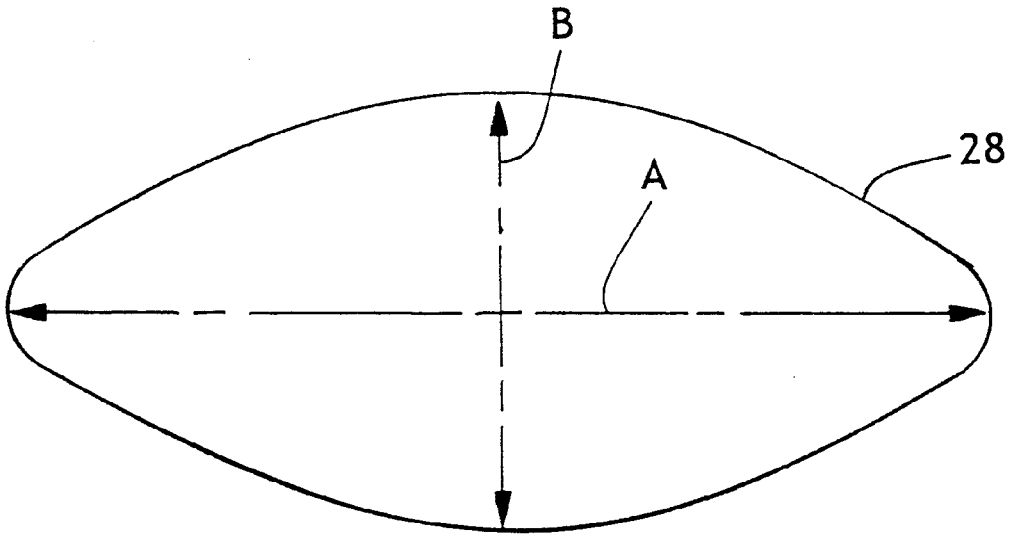

In some instances, for example in FIGS. 8C and 8D, broken line B1 and B2 illustrate separate width dimensions of varying size within each of the respective shapes. However, in these instances, the length dimension A remains greater than the larger of either width dimension B1 or B2.

The shape of the opening 28 illustrated in FIGS. 1, 2 and 5 may be characterized as "rod-shaped". The "rod-shaped" opening may be described as an elongated aperture having rounded ends, the width of the aperture increasing around the mid-point of the length of the aperture. Specifically, the width increases to a particular width and remains constant until the width again decreases to the previous width of the aperture.

Figure 7:
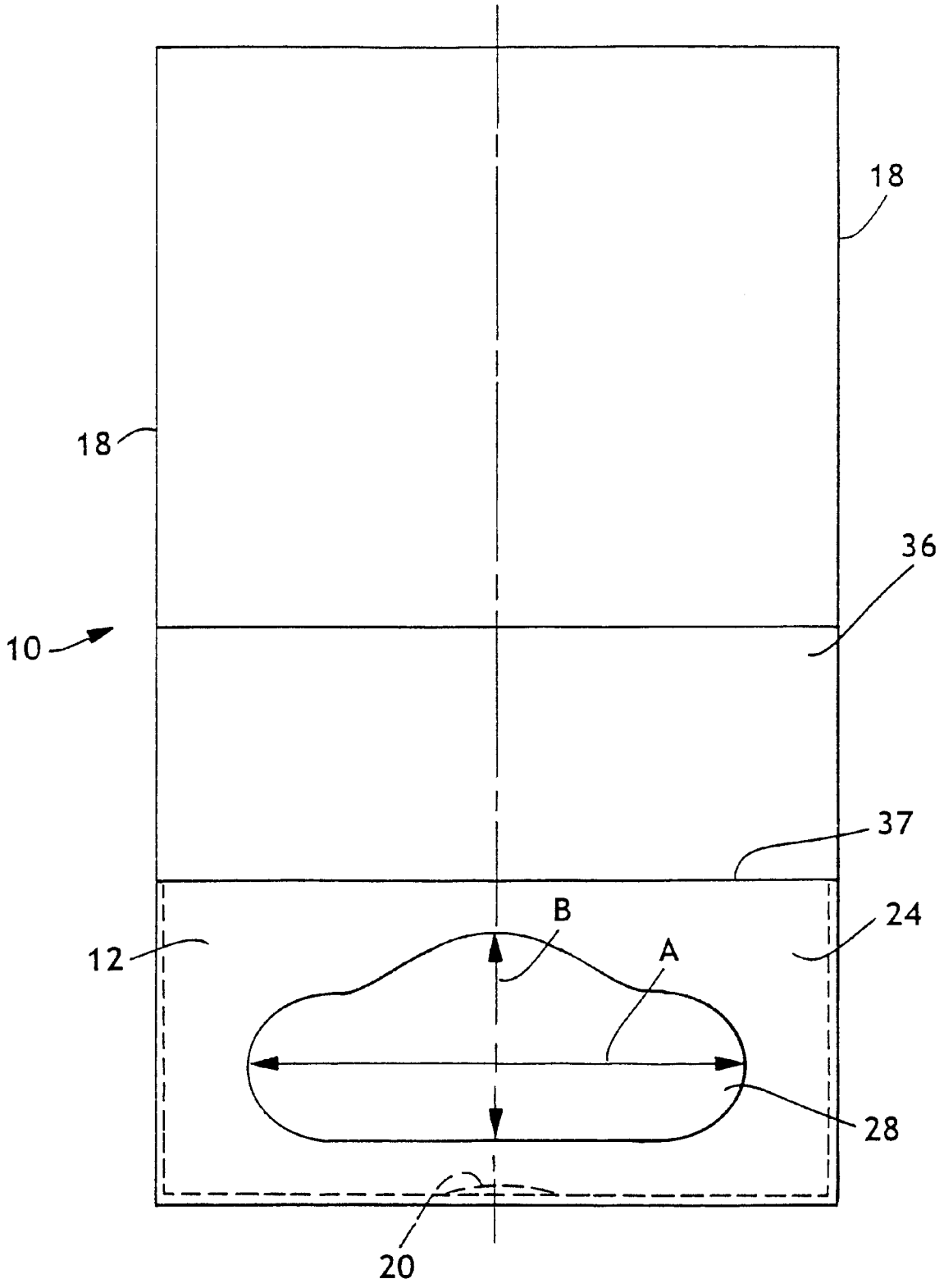
FIG. 7 is a front view of still another embodiment of the adapter according to the present invention.

The opening 28 depicted in FIG. 7 is an elongated aperture having rounded ends, a substantially straight lower edge, and an upper edge which is arcs upwardly close to the middle along the length of the opening.

Referring now to FIG. 8A, the shape of the opening 28 disclosed therein may be characterized as "star-shaped", in that the opening 28 looks somewhat similar to an elongated four-pointed star. As shown in FIG. 8B, the opening 28 may be characterized as "clover-shaped". The "clover-shaped" opening is similar to the "rod-shaped" opening, except that the increase in width near the mid-point of the aperture length is roughly in the shape of a half-circle formed along the lower and upper edges of the opening, the half-circle being centered near the midpoint of the length dimension.

The opening 28 illustrated in FIG. 8C may be characterized as "dumbbell-shaped", as the aperture is an elongated opening having enlarged, rounded ends. The opening 28 illustrated in FIG. 8D may be characterized as "keyhole-shaped" and is similar to the "dumbbell-shaped" opening, except that the diameter of the opening 28 is enlarged at one end only. The opening 28 illustrated in FIG. 8E may be characterized as "oval-shaped".

Figure 9:
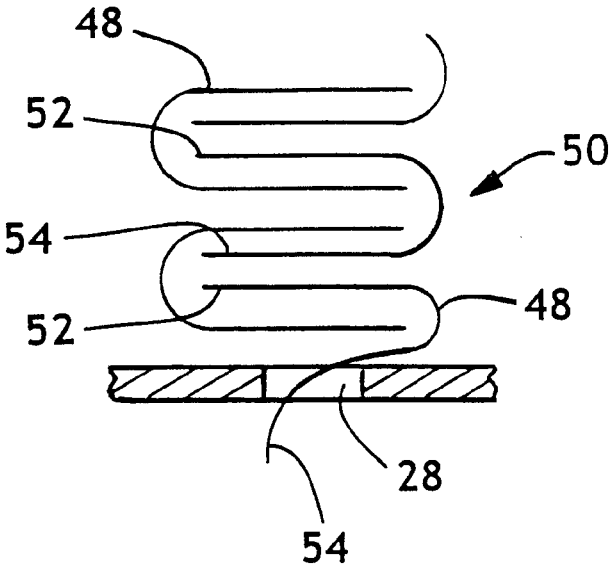
FIG. 9 is a schematic cross-section illustrating a dispensing sequence for a plurality of vertically stacked, interfolded sheets.

Referring now to FIG. 9, a column 50 including a plurality of vertically stacked folded sheets 48 is shown therein. Although many different arrangements of interfolded sheets may be used in the present invention, FIG. 9 illustrates particular interfolding arrangement. Within column 50, each sheet 48 is generally folded in half upon itself such that the folded halves capture the trailing edge 52 of the sheet 48 directly below it and the leading edge 54 of the sheet directly above it. The column 50 is supported within the adapter 10. Each sheet 48 also includes spaced-apart side edges which are urged inwardly by the opening as the sheets 48 pass through the opening in the lower portion of the front wall.

While the invention has been described in detail with respect to specific embodiments thereof, it will be appreciated that those skilled in the art, upon attaining an understanding of the foregoing, may readily conceive of alterations to, variations of and equivalents to these embodiments.

What is claimed is:

1. An adapter, capable of conforming to the interior shape of a rolled material dispenser, the adapter being configured to securely protect its contents from users and yet be conveniently refilled, the adapter providing a plurality of vertically stacked, interfolded sheets for dispensing, comprising:

a housing comprising an interior adapted to receive a plurality of vertically stacked, interfolded sheets, each sheet including a leading edge and a trailing edge separated by spaced-apart side edges, said housing further comprising an exterior having a plurality of walls sized to conform to the interior space of a mounted rolled material dispenser, the housing having a bottom wall, front wall, and back wall;

an opening having a width dimension, the opening formed in the front wall of the housing, the opening adapted to dispense stacked interfolded sheets from the interior of the housing, the side edges of the sheets being urged inwardly by the width dimension of the opening as the sheets pass through the opening; and a door attached to the housing, the door being positioned on the front wall of the housing and being restricted from opening by an outer restricting means, the door being adapted to be capable of moving between (i) an open position for refilling the dispenser through the door and (ii) a closed position for dispensing, whereby the adapter is configured to fit within said rolled material dispenser to convert the rolled material dispenser to a dispenser capable of supplying folded sheets.

2. The adapter of claim 1 in which the dispenser is configured for a:

i) dispensing configuration, and ii) a loading configuration, such that the dispenser is adapted to restrict access to the door when the dispenser is in the dispensing configuration, and conversely to facilitate access to the door to allow loading new sheets into the dispenser in the loading configuration.

3. The adapter of claim 1, the housing further including a bottom wall including a boss extending upwardly into the interior of the housing.

4. The adapter of claim 1, the opening further comprising a length dimension and a width dimension, the length dimension being greater than the width dimension.

5. The adapter of claim 1, the housing being formed of plastic.

6. The adapter of claim 1 further including an attachment mechanism adapted to attach the housing to a dual roll vertically stacked dispenser.

7. The adapter of claim 6, the attachment mechanism including an adhesive.

8. An adapter, capable residing within a rolled material dispenser that retains a plurality of vertically stacked, interfolded sheets the adapter comprising:

a housing comprising interfolded sheets, each sheet including a leading edge and a trailing edge separated by spaced-apart side edges, a bottom wall including a boss extending upwardly into the housing, a front wall, a back wall spaced apart from the front wall, and two spaced-apart side walls, each side wall extending between the back wall and the front wall;

wherein said back, bottom, and side walls further comprise exterior surfaces, the exterior surface of the back wall, bottom wall, and side walls conforming to the interior space of a mounted rolled paper dispenser, an opening having a width dimension formed in the front wall, the opening adapted to dispense vertically stacked interfolded sheets from the interior of the housing, the side edges of the sheets being urged inwardly by the width dimension of the opening as the sheets pass through the opening; and a door located on the front wall and attached to the housing, the door being configured for moving between:

i) an open position for refilling the dispenser by inserting sheets through the open door, and ii) a closed position for dispensing sheets;

whereby the adapter is configured to fit within said rolled material dispenser to convert a rolled material dispenser to a dispenser capable of supplying individual sheets.

9. The adapter of claim 8, the opening being disposed on the lower portion of the front wall of the housing.

10. The adapter of claim 8, the opening further comprising a length dimension and a width dimension, the length dimension being greater than the width dimension.

11. The adapter of claim 8, the door being pivotably mounted to the housing.

12. The adapter of claim 8, the front wall further including an upper portion and a lower portion which are joined along a front edge.

13. The adapter of claim 12, a first interior angle being formed by the lower portion and the upper portion of the front wall, the first interior angle being less than 180 degrees.

14. The adapter of claim 8, the back wall further comprising an upper portion and a lower portion which are joined at a back edge.

15. The adapter of claim 14, a second interior angle being formed by the lower portion and the upper portion of the back wall, the second interior angle being less than 180 degrees.

16. The adapter of claim 8 further including an attachment mechanism adapted to attach the housing to a dual roll vertically stacked dispenser.

17. The adapter of claim 16, the attachment mechanism including an adhesive.

* * * * *